United States Patent [19]

Evens

[11] Patent Number: 5,074,280

[45] Date of Patent: Dec. 24, 1991

[54] SECTIONAL HIGH EFFICIENCY HEAT EXCHANGER

[75] Inventor: Lance J. Evens, Carrollton, Tex.

[73] Assignee: Lennox Industries Inc., Richardson, Tex.

[21] Appl. No.: 668,600

[22] Filed: Mar. 13, 1991

[51] Int. Cl.[5] ..... F24H 3/02

[52] U.S. Cl. ..... 126/110 R; 126/116 R

[58] Field of Search ..... 126/110 R, 116 R, 116 B

[56] References Cited

U.S. PATENT DOCUMENTS

| | | | |
|---|---|---|---|
| 1,927,174 | 9/1933 | Jones . | |
| 2,247,849 | 7/1941 | Ritter . | |
| 2,923,349 | 2/1960 | Marble et al. | 126/116 R |
| 3,294,082 | 12/1966 | Norris . | |
| 3,324,845 | 6/1967 | White . | |
| 3,807,382 | 4/1974 | Kennedy . | |
| 4,460,329 | 7/1984 | Trent . | |
| 4,467,780 | 8/1984 | Ripka . | |
| 4,729,207 | 3/1988 | Dempsey et al. . | |
| 4,739,746 | 4/1988 | Tomlinson . | |
| 4,837,767 | 12/1989 | Thompson et al. . | |
| 4,848,314 | 7/1989 | Bentley . | |

*Primary Examiner*—Carroll B. Dority

[57] ABSTRACT

The improved sectional high efficiency heat exchanger of the present invention comprises apparatus for directing hot flue gases backwardly and into a defined lower combustion chamber. Whereupon, such hot flue gases are directed forwardly in the lower combustion chamber through the upper part thereof. The heated air stream flow is then directed into and to the rear of a lower flue pass, and finally forwardly and to the front of the heat exchanger through an upper flue pass for exiting into a flue collector box. As a result of the above structure, during the burner-"off" cycle combusting gases from the pilot burner are permitted to flow upwardly along the front wall of the lower combustion chamber and into the upper flue passes, thus permitting the heat exchanger to obtain the benefit of the heat energy of the pilot burner gas during the burner-"off" cycle.

15 Claims, 2 Drawing Sheets

SECTIONAL HIGH EFFICIENCY HEAT EXCHANGER

BACKGROUND OF THE INVENTION

The present invention is directed to furnace components in general, and more particularly to an improved sectional high efficiency heat exchanger for use in association with a power vent, gas-fired, forced-air furnace, and yet more particularly to an improved heat exchanger apparatus for operative functioning both during the burner-"on" cycle and also during the burner-"off" cycle, whereby heat energy expended by the pilot burner is conserved.

Prior art patents particularly as exemplified by U.S. Pat. Nos. 4,467,780, 4,729,207, 4,848,314, 4,887,767 depict various forms of serpentine-shaped heat exchangers, which are thus necessarily directed to similarly shaped combustion gas flow patterns. However, such heat exchanger structures have typically included a baffle or baffles disposed within and dividing the lower combustion chambers thereof into two separate subchambers. The inclusion of such baffles in these prior art lower combustion chambers has prevented the forced air furnace from achieving the benefit of the heat energy for heat exchange as provided by and from the gas combustion pilot burner during the burner-"off" cycle.

It is therefore a material object of the present invention to provide an improved sectional high efficiency heat exchanger for exchange of heat both during the burner-"on" and the burner-"off" cycles.

Another object of the present invention is to provide a versatile gas-fired sectional heat exchanger utilizable in power vent designs and which can be utilized at high heat loading level per unit area, and can also be used with flexibility and versatility in furnaces employing either a standing pilot or utilizing an electric burner ignition means.

These and other objects and advantages of the improved sectional high efficiency heat exchanger apparatus of the present invention will be come more readily apparent to those skilled in the art upon review of the following description of the invention.

SUMMARY OF THE INVENTION

In general terms, the structure of the improved sectional high efficiency heat exchanger of the present invention comprises clam-shell or other formed sheet metal heat exchanger apparatus for directing hot flue gases backwardly and into a defined lower combustion chamber, then forwardly in the lower combustion chamber through the upper part thereof. The heated air stream flow is then directed into and to the rear of a lower flue pass, and finally forwardly and to the front of the heat exchanger through an upper flue pass for exiting into a flue collector box.

As a result of the above structure, during the burner-"off" cycle combusting gases from the pilot burner are permitted to flow upwardly along the front wall of the lower combustion chamber and into the upper flue passes, thus permitting the heat exchanger to obtain the benefit of the heat energy of the pilot burner gas during the burner-"off" cycle.

In regard to the hereinafter described drawing, certain preferred embodiments are set forth; however, various modifications and alternative embodiments and constructions can be made without departing from the true spirit and scope of the present invention.

BRIEF DESCRIPTION OF THE DRAWING

The improved sectional high efficiency heat exchanger of the present invention is pictorially set forth in the following described Figures of the drawing, wherein common reference numerals are utilized for common elements, and in which.

DETAILED DESCRIPTION OF PREFERRED EMBODIMENTS

Figure 1:
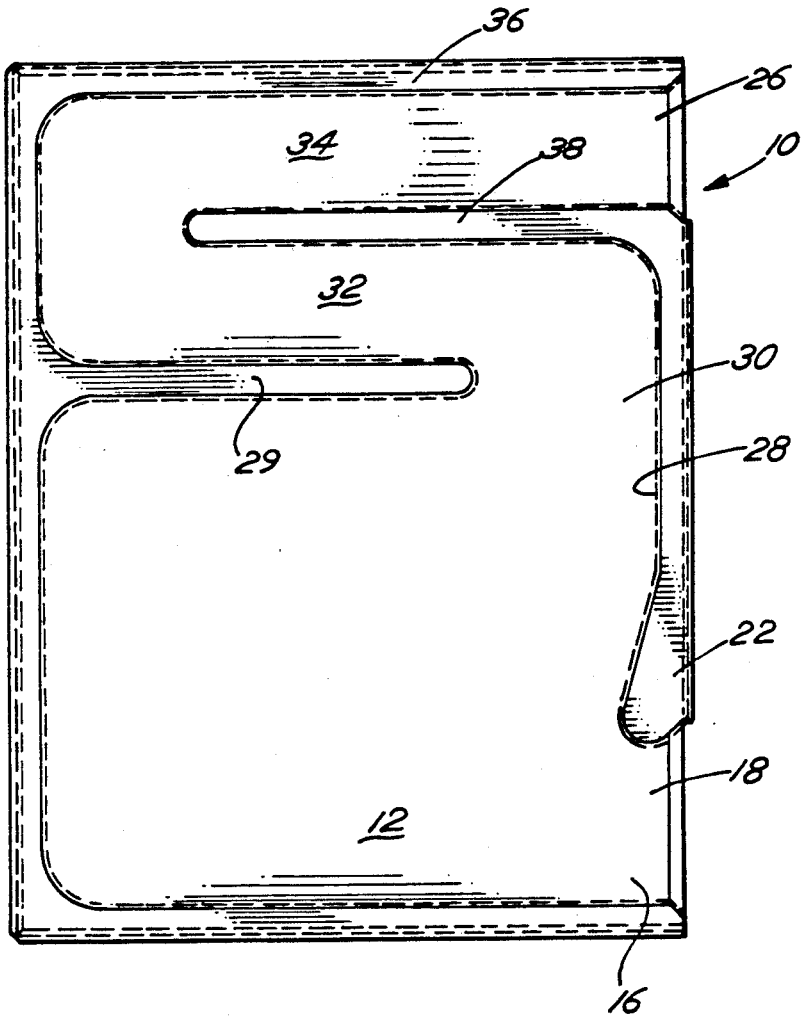
FIG. 1 is a longitudinal cross sectional view of the improved sectional high efficiency heat exchanger of the present invention showing the lower chamber disposed at the lower portion of the heat exchanger, and having an opening therein for entry access by combusting gases both from the principal burner and from the pilot burner, and showing paired upper flue pass chambers disposed above the lower combustion chamber for serial flow therethrough of heated combustion gases.

In the improved sectional high efficiency heat exchanger apparatus of the present invention, structure is provided for allowing the extraction of heat from the heated air combustion stream present during both the burner-"on" and the burner-"off" cycles.

The improved heat exchanger apparatus of the present invention includes a lower disposed combustion chamber which is formed from a heat conducting material, such as sheet metal. Heat conducting materials for use in fabricating the structure of the present invention include types and forms known to those skilled in the present art.

The combustion chamber is disposed at the lower portion of the heat exchanger apparatus. A principal burner preferably for burning a gaseous fuel is disposed at the lower portion of the heat exchanger to inject combusting fuel to form a heated air stream into an opening therein. In accordance with commonly accepted structures and procedures, a plurality of principal burners each having a corresponding heat exchanger of the structure hereof, may be disposed in operative and spaced sectional array.

A pilot burner is also disposed adjacent the front wall of the lower portion of the lower combustion chamber, and at an opening thereunto, and is utilized for igniting the principal burner upon a suitable signal of known methods, in order to render the principal burner into the burner-"on" position. The pilot burner remains in lighted condition when the principal burner is in the burner-"off" position.

The lower combustion chamber defines a sinuous, or serpentine-like, flow path for the combusting fuel when the principal burner is in the burner-"on" position. This sinuous flow path is first rearwardly directed into the lower portion of the lower combustion chamber, and is thereafter reflexively directed forwardly therefrom at the upper portion of the lower disposed combustion chamber. Such lower combustion chamber also simultaneously defines an upwardly directed pilot burner heat flow path which is disposed adjacent the front wall of the heat exchanger lower combustion chamber for the flow of a pilot burner heated air stream adjacent to the front wall, when the principal burner is in the burner-"off" position.

A combustion gas exit is provided for exiting flow of the heated air stream supplied by the principal burner and the pilot burner.

According to the above structure, the heat energy from each of the principal burner heated air stream and the pilot burner heated air stream (i.e., when the burner is respectively in the burner-"on" and the burner-"off" positions) is disposed adjacent and flows onto the various surfaces of the lower combustion chamber for heat exchange.

The improved heat exchanger apparatus of the present invention includes a flue pass chamber which is also formed of a suitable heat conducting material, and which is disposed above the lower combustion chamber. In a preferred embodiments, the flue pass chamber may be formed integrally with the lower combustion chamber. One method of fabrication is by means of stamping sheet metal into the structure hereof, according to clam-shell structures of the type which have been previously practiced by those skilled in the art.

The flue pass chamber receives the heated air stream of the lower combustion chamber in preferred embodiments at the lower, front portion of the flue pass chamber. Such heated air stream is likewise received adjacent the front wall of the lower combustion chamber. The flue pass chamber associated with the improved heat exchanger apparatus of the present invention includes at least upper and lower flue passes for respectively directing the heated air stream rearwardly and then forwardly, although additional flue passes may be included in alternative embodiments.

Combustion gas exit means are preferably disposed at the upper flue pass structure of the improved heat exchanger apparatus of the present invention, and near the top of the heat exchanger and adjacent to the front wall thereof in preferred embodiments. These and other combustion gas exit means contemplated in such preferred embodiments preferably receive the heated air stream from the upper flue pass. Such combustion gas exit means are also preferably disposed above, and in some embodiments directly above the access opening for the principal burner.

The upper and lower flue passes in the flue pass chamber of the improved heat exchanger apparatus of the present invention are defined by at least a single flue pass septum or wall which is disposed within the flue pass chamber, although additional flue pass septa are contemplated. These flue pass septa extend from the front wall in the case of one flue pass septum, and alternately from the front wall and rear wall for any additional flue pass septa. These flue pass septa are sealingly secured to, and may be formed integrally with (such as for example by clam-shell construction techniques as known to those skilled in the art) the inner surface of the front and/or rear wall of the improved heat exchanger apparatus of the present invention.

In other preferred embodiments hereof, structural impediments for preventing direct flow of the heated air stream from the lower combustion chamber directly to the combustion gas exit means and without traversing the lower and upper flue passes are provided. Such direct flow impediments preferably include septa or baffles disposed within the heat exchanger apparatus. In other preferred embodiments, heated air stream flow control means are provided for directing the heated air stream from the principal burner consecutively rearwardly, forwardly, rearwardly, and finally forwardly prior to exiting thereof by means of the combustion gas exit means.

In these and other preferred embodiments of the present invention, the lower combustion chamber preferably has a thickness which is substantially less than the height thereof. The lower combustion chamber may also preferably have a width which is substantially greater than the width of the flue pass chamber. Yet further, the lower combustion chamber is preferably tapered in width at the upper portion thereof. Additionally, the volume of the upper flue pass chamber is preferably substantially less than the volume of the lower combustion chamber.

Referring now to the drawings, the improved sectional high efficiency heat exchanger apparatus of the present invention generally 10 includes a lower disposed combustion chamber 12.

A principal burner 14 preferably for burning a gaseous fuel is disposed at the lower portion 16 of heat exchanger 10 to inject combusting fuel to mix with air and form a heated air stream into an access opening 18 therein. A plurality of principal burners 14 each having a corresponding sectional heat exchanger 10 of the structure hereof may be disposed in operative and spaced array in a single furnace.

A pilot burner 20 is also disposed adjacent the front wall 22 of lower portion 16 of lower combustion chamber 12, and at access opening 18 thereinto, and is utilized for igniting principal burner 14 upon a suitable signal of known methods, in order to render principal burner 14 into the burner-"on" position. Pilot burner 20 remains in lighted condition when principal burner 14 is in the burner-"off" position.

Figure 3:
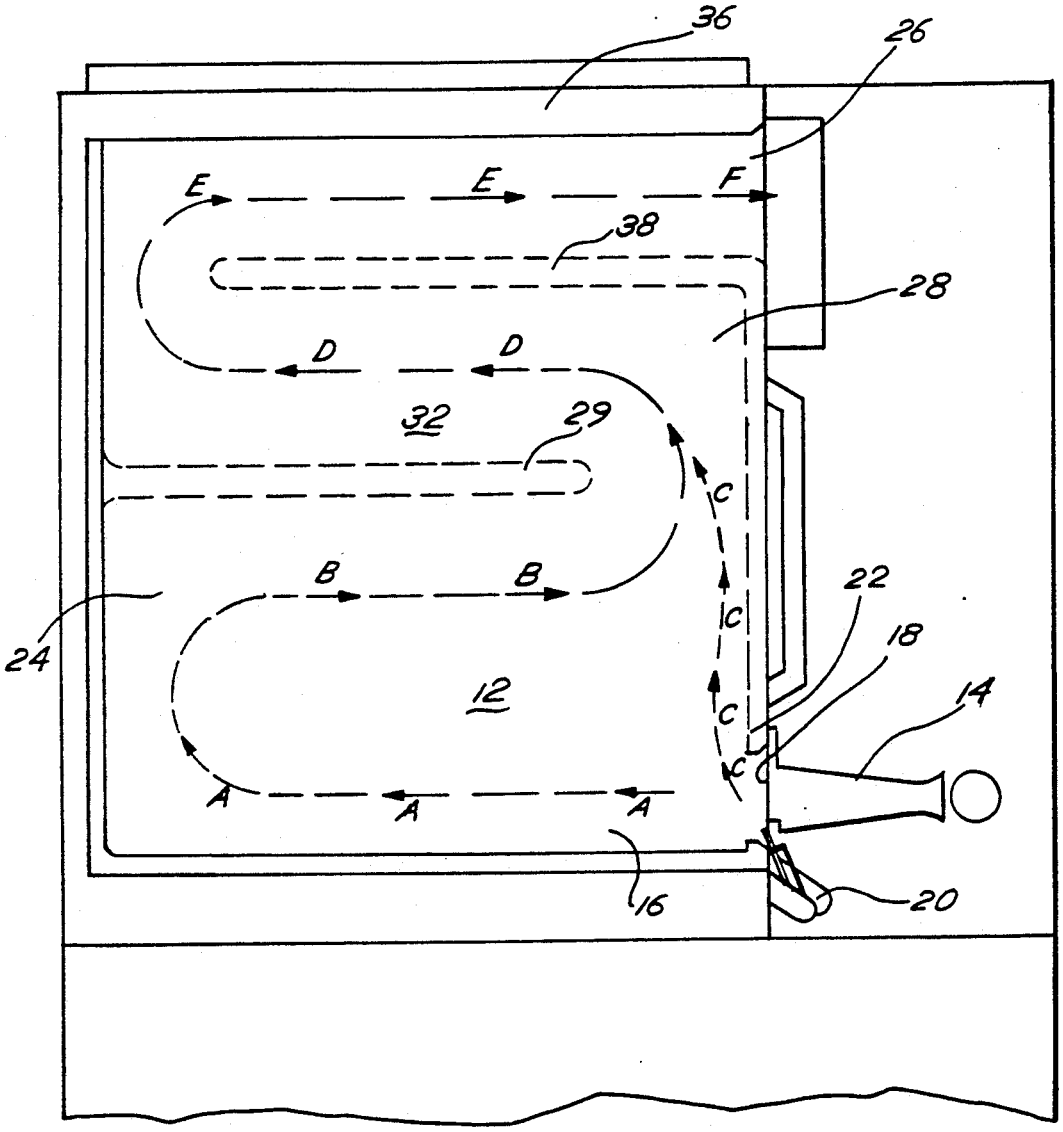
FIG. 3 is a view similar to that of FIG. 1, and further showing schematically by means of Arrows A–F the flow path of the heated combustion gas stream in both the burner-"on" and burner-"off" positions, to make heat energy from both such heated combustion gas streams available for use in the heat exchanger apparatus in both the burner-"on" and the burner-"off" positions.

As shown particularly in FIG. 3, lower combustion chamber 12 defines a sinuous flow path for the combusting fuel when principal burner 14 is in the burner-"off" position. This sinuous flow path is first rearwardly directed (Arrows A) into lower portion 16 of lower combustion chamber 12, and is thereafter reflexively directed forwardly therefrom (Arrows B) at upper portion 24 of lower disposed combustion chamber 12. Lower combustion chamber 12 also simultaneously defines an upwardly directed pilot burner heated air stream (Arrows C) which is disposed adjacent front wall 22 of heat exchanger lower combustion chamber 12 for the flow of the pilot burner heated air stream (Arrows C) adjacent to front wall 22, when principal burner 14 is in the burner-"off" position.

A combustion gas exit 26 is provided for exiting flow of the heated air stream from principal burner 14 and from pilot burner 20.

According to the above structure, the heat energy from each of principal burner heated air stream (Arrows A and B) and the pilot burner heated air stream (Arrows C) (i.e., when principal burner 14 is respectively in the burner-"on" and the burner-"off" positions) is disposed adjacent and flows onto the inner surface 27 of front wall 22 of lower combustion chamber 12.

The improved heat exchanger apparatus of the present invention 10 further includes a flue pass chamber 28, which is also formed of a suitable heat conducting material, and which is disposed above lower combustion chamber 12 and separated therefrom by a septum 29. In preferred embodiments, the flue pass chamber 28 may be formed integrally with lower combustion chamber 12. Flue pass chamber 28 receives the heated air stream of lower combustion chamber 12 in preferred embodiments at the lower, front portion 30 of flue pass chamber 28. Such heated air stream is likewise received adjacent the front wall 22 of lower combustion chamber 12.

Flue pass chamber 28 of the improved heat exchanger apparatus 10 hereof includes at least lower and upper flue passes 32,34 for respectively directing the heated air stream at least rearwardly (Arrows D) and then forwardly (Arrows E).

A combustion gas exit 26 is disposed at upper flue pass 34 and near the top 36 of heat exchanger 10 and adjacent to front wall 22 thereof in preferred embodiments. Combustion gas exit 26 receives the heated air stream (Arrows E) from upper flue pass 34 for exiting the heat exchanger 10 (Arrow F). Such combustion gas exit 26 is disposed above, and in some embodiments in a direct line above the access opening 18 for principal burner 14.

The lower and upper flue passes 32,34 in flue pass chamber 32 of improved heat exchanger apparatus 10 are defined by at least a single flue pass septum 38 which is disposed within flue pass chamber 32. Flue pass septum 38 extends from front wall 22, and is sealingly secured to, and may be formed integrally with inner surface 27 of front wall 22 of improved heat exchanger apparatus 10 of the present invention.

Figure 2:
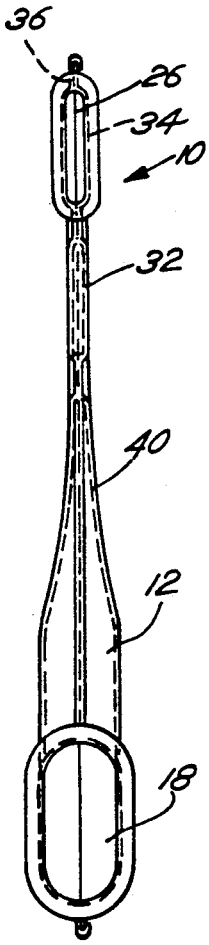
FIG. 2 is a front view of the improved sectional high efficiency heat exchanger of the present invention showing the combustion gas opening at the bottom portion thereof for entry of combustion gases from the principal burner, and for entry access by combusting gases from the pilot burner, and further showing at the top thereof a combustion gas exit for flow from the flue pass chambers of the circulated heated combustion gases from the heat exchanger apparatus.

As shown in the embodiments of FIGS. 1-3, and FIG. 2 in particular, lower combustion chamber 12 preferably has a thickness which is substantially less than the height thereof. Also as shown in FIG. 2, lower combustion chamber 12 may also preferably have a width which is substantially greater than the width of flue pass chamber 28.

Yet further, lower combustion chamber 12 is preferably tapered in width at the upper portion 40 thereof. Additionally, and as shown in FIG. 2, the volume of flue pass chamber 28 is substantially less than the volume of lower combustion chamber 12.

The basic and novel characteristics of the improved methods and apparatus of the present invention will be readily understood from the foregoing disclosure by those skilled in the art. It will become readily apparent that various changes and modifications may be made in the form, construction and arrangement of the improved apparatus of the present invention, and in the steps of the inventive methods hereof, which various respective inventions are as set forth hereinabove without departing from the spirit and scope of such inventions. Accordingly, the preferred and alternative embodiments of the present invention set forth hereinabove are not intended to limit such spirit and scope in any way.

What is claimed is:

1. An improved sectional high efficiency heat exchanger for exchange of heat both during the burner-"on" and burner-"off" cycles of a gas-fired, forced-air furnace, said heat exchanger comprising:

a lower combustion chamber means formed of heat conducting material and having a front wall thereof with an inner surface, said lower combustion chamber disposed at the lower portion of said heat exchanger and having a principal burner means disposed adjacent the front wall of said lower chamber and at the lower portion thereof for injecting combusting fuel to form a heated air stream directed backwardly into said lower combustion chamber, and a pilot burner means also disposed adjacent said front wall of said lower portion of said lower combustion chamber for igniting said principal burner means to render said principal burner means into the burner-"on" position, and for remaining in lighted condition when said principal burner means is in the burner-"off" position, said lower combustion chamber having a closed rear wall means for deflecting combustion gases from said principal burner means forwardly to an upper portion of said lower combustion chamber when said principal burner means is in the burner-"on" position, and further defining an upwardly disposed heat flow path disposed adjacent said front wall of said heat exchanger lower combustion chamber for flow of combustion gases from said pilot burner when said principal burner means is in the burner-"off" position; and for flow of combustion gases from said principal burner means in the burner-"on" position, and combustion gas exit means for exiting flow of the combustion gas streams from said principal burner means and from said pilot burner means from said heat exchanger;

whereby heat from said pilot burner means heated air stream when said principal burner is in the burner-"off" position is disposed adjacent and onto the inner surface of said front wall of said lower combustion chamber for absorption of the heat energy therefrom.

2. The improved sectional heat exchanger of claim 1 further comprising a flue pass chamber having a lower front portion thereof, said flue pass chamber formed of heat conducting material and disposed above said lower combustion chamber and receiving a heated air stream therefrom at said lower front portion thereof and adjacent said front wall of said lower combustion chamber.

3. The improved sectional heat exchanger of claim 2 wherein said flue pass chamber includes upper and lower flue passes for sequentially directing the heated air stream rearwardly and then forwardly.

4. The improved sectional heat exchanger of claim 3 wherein said combustion gas exit means is disposed near the top of said heat exchanger and adjacent said front wall thereof.

5. The improved sectional heat exchanger of claim 4 wherein said combustion gas exit means receives the heated air stream from said upper flue pass.

6. The improved sectional heat exchanger of claim 5 wherein said combustion gas exit means is disposed above said principal burner means.

7. The improved sectional heat exchanger of claim 3 wherein said upper and lower flue passes are defined by a flue pass septum disposed within said flue pass chamber.

8. The improved sectional heat exchanger of claim 7 wherein said flue pass septum extends rearwardly from said front wall.

9. The improved sectional heat exchanger of claim 8 wherein said flue pass septum is sealingly secured to said inner surface of said front wall.

10. The improved sectional heat exchanger of claim 9 further comprising means for preventing flow of the heated air stream from said lower combustion chamber directly to said combustion gas exit means and without traversing said lower and upper flue passes.

11. The improved sectional heat exchanger of claim 1 wherein said lower combustion chamber has a thickness which is substantially less than the height thereof.

12. The improved sectional heat exchanger of claim 2 further comprising heated air stream flow control means for directing the heated air stream from said principal burner means consecutively rearwardly, forwardly, rearwardly and forwardly prior to exiting thereof by means of said combustion gas exit means.

13. The improved sectional heat exchanger of claim 2 wherein said lower combustion chamber has a width which is substantially greater than the width of said flue pass chamber.

14. The improved sectional heat exchanger of claim 2 wherein said lower combustion chamber is tapered in width at the upper portion thereof.

15. The improved sectional heat exchanger of claim 2 wherein the volume of said flue pass chamber is substantially less than the volume of the lower combustion chamber.

* * * * *